US011263972B2

(12) United States Patent
Wu et al.

(10) Patent No.: US 11,263,972 B2
(45) Date of Patent: Mar. 1, 2022

(54) PIXEL CIRCUITRY AND DRIVE METHOD THEREOF, ARRAY SUBSTRATE, AND DISPLAY PANEL

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Hao Wu, Beijing (CN); Yangli Zheng, Beijing (CN); Xingpan Sun, Beijing (CN); Na An, Beijing (CN); Gang Ci, Beijing (CN); Baolei Guo, Beijing (CN); Lingguo Wang, Beijing (CN); Jianguo Zhu, Beijing (CN); Wei Su, Beijing (CN); Zheng Zhang, Beijing (CN); Xiao Ma, Beijing (CN); Hyungkyu Kim, Beijing (CN); Site Cai, Beijing (CN); Binbin Liu, Beijing (CN); Hui Yin, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 223 days.

(21) Appl. No.: 16/465,746

(22) PCT Filed: Oct. 30, 2018

(86) PCT No.: PCT/CN2018/112560

§ 371 (c)(1),
(2) Date: May 31, 2019

(87) PCT Pub. No.: WO2019/184331

PCT Pub. Date: Oct. 3, 2019

(65) Prior Publication Data

US 2021/0097938 A1 Apr. 1, 2021

(30) Foreign Application Priority Data

Mar. 30, 2018 (CN) ..... 201810298035.6

(51) Int. Cl.
*G09G 3/3266* (2016.01)
*G09G 3/3258* (2016.01)

(52) U.S. Cl.
CPC ..... *G09G 3/3266* (2013.01); *G09G 3/3258* (2013.01); *G09G 2300/0408* (2013.01);
(Continued)

(58) Field of Classification Search
CPC combination set(s) only.
See application file for complete search history.

(56) References Cited

U.S. PATENT DOCUMENTS

2014/0320477 A1 10/2014 Izawa et al.
2016/0329015 A1* 11/2016 Ji ..... G11B 19/28

FOREIGN PATENT DOCUMENTS

CN 101266752 A 9/2008
CN 101276541 A 10/2008
(Continued)

OTHER PUBLICATIONS

PCT International Search Report, Application No. PCT/CN2018/112560, dated Jan. 29, 2019, 5 pages: with English translation.
(Continued)

*Primary Examiner* — Robin J Mishler
(74) *Attorney, Agent, or Firm* — Armstrong Teasdale LLP

(57) ABSTRACT

Embodiments of the present disclosure provide a pixel circuitry and a drive method thereof, an array substrate, and a display panel. The pixel circuitry includes a shift register unit, an inverter, and a pixel driving circuit. The shift register unit is configured to provide a first drive signal under the control of an enable signal, a first clock signal, and a second
(Continued)

clock signal. The inverter is configured to invert the first drive signal to generate a second drive signal. The pixel driving circuit is configured to control a light emitting device according to the first drive signal and the second drive signal.

17 Claims, 4 Drawing Sheets

(52) U.S. Cl.
CPC ..... *G09G 2300/0426* (2013.01); *G09G 2310/0286* (2013.01); *G09G 2310/08* (2013.01)

(56) References Cited

FOREIGN PATENT DOCUMENTS

| | | | |
|---|---|---|---|
| CN | 101471033 | A | 7/2009 |
| CN | 102831860 | A | 12/2012 |
| CN | 104103253 | A | 10/2014 |
| CN | 104134425 | A | 11/2014 |
| CN | 104282288 | A | 1/2015 |
| CN | 105304021 | A | 2/2016 |
| CN | 105976759 | A | 9/2016 |
| CN | 106952602 | A | 7/2017 |
| CN | 107707243 | A | 2/2018 |
| CN | 108257550 | A | 7/2018 |
| KR | 20090057798 | A | 6/2009 |
| KR | 20160054372 | A | 5/2016 |

OTHER PUBLICATIONS

PCT Written Opinion, Application No. PCT/CN2018/112560, dated Jan. 29, 2019, 6 pages.: with English translation of relevant part.
China First Office Action, Application No. 201810298035.6, dated Jun. 3, 2019, 31 pps.: with English translation.
China Second Office Action, Application No. 201810298035.6, dated Oct. 21, 2019, 25 pps.: with English translation.

* cited by examiner

PIXEL CIRCUITRY AND DRIVE METHOD THEREOF, ARRAY SUBSTRATE, AND DISPLAY PANEL

CROSS REFERENCE TO RELATED APPLICATIONS

This patent application is a National Stage Entry of PCT/CN2018/112560 filed on Oct. 30, 2018, which claims the benefit and priority of Chinese Patent Application No. 201810298035.6 filed on Mar. 30, 2018, the disclosures of which are incorporated by reference herein in their entirety as part of the present application.

BACKGROUND

The present disclosure relates to the field of display technologies, and more particularly, to a pixel circuitry and a drive method thereof, an array substrate, and a display panel.

With development of display technologies, a new generation of organic light emitting diode (OLED) display devices have advantages, such as lower manufacturing cost, faster response speed, higher contrast ratio, wider viewing angle, larger operating temperature range, brighter color, and lighter weight, and do not need backlight units, compared with conventional liquid crystal display (LCD) devices. Therefore, currently, the OLED display technologies have become the fastest-growing display technologies.

To improve process integration level of OLED panels and reduce costs thereof, generally, gate driving circuits of thin film transistors (TFT) are integrated on array substrates of display panels to implement scan drive for the display panels by employing Gate Driver On Array (GOA) technologies. The gate driving circuits integrated on the array substrates by employing the GOA technologies are also referred to as GOA units or shift register units. For the display devices using the GOA units, the costs can be reduced from material and manufacturing processes aspects because the portion of binding the driving circuits is omitted.

BRIEF DESCRIPTION

Embodiments of the present disclosure provide a pixel circuitry and a drive method thereof, an array substrate, a display panel, and a display device.

A first aspect of the present disclosure provides a pixel circuitry. The pixel circuitry includes a shift register unit, an inverter, and a pixel driving circuit. The shift register unit is configured to provide a first drive signal via an output signal terminal of the shift register unit under the control of an enable signal from an enable signal terminal, a first clock signal from a first clock signal terminal, and a second clock signal from a second clock signal terminal. The inverter is configured to invert the first drive signal to generate a second drive signal. The pixel driving circuit is configured to control a light emitting device according to the first drive signal and the second drive signal. The first clock signal has an opposite phase to the second clock signal.

In some embodiments of the present disclosure, the shift register unit includes an input circuit, a pull-down circuit, a control circuit, a first output circuit, and a second output circuit. The input circuit may control a voltage of a first node according to the first clock signal and the enable signal. The pull-down circuit may control a voltage of a second node according to the first clock signal and a first voltage signal from a first voltage signal terminal. The control circuit may control the voltage of the second node according to the voltage of the first node and the first clock signal. The first output circuit may provide the first drive signal to the output signal terminal of the shift register unit according to the voltage of the second node and a second voltage signal from a second voltage signal terminal. The second output circuit may provide the first drive signal to the output signal terminal according to the voltage of the first node and the second clock signal.

In some embodiments of the present disclosure, the input circuit may include a first transistor. A control electrode of the first transistor is coupled to the first clock signal terminal, a first electrode of the first transistor is coupled to the enable signal terminal, and a second electrode of the first transistor is coupled to the first node.

In some embodiments of the present disclosure, the pull-down circuit may include a second transistor. A control electrode of the second transistor is coupled to the first clock signal terminal, a first electrode of the second transistor is coupled to the first voltage signal terminal, and a second electrode of the second transistor is coupled to the second node.

In some embodiments of the present disclosure, the control circuit may include a third transistor. A control electrode of the third transistor is coupled to the first node, a first electrode of the third transistor is coupled to the first clock signal terminal, and a second electrode of the third transistor is coupled to the second node.

In some embodiments of the present disclosure, the first output circuit may include a fourth transistor and a first capacitor. A control electrode of the fourth transistor is coupled to the second node, a first electrode of the fourth transistor is coupled to the second voltage signal terminal, and a second electrode of the fourth transistor is coupled to the output signal terminal. The first capacitor is coupled between the second node and the second voltage signal terminal.

In some embodiments of the present disclosure, the second output circuit may include a fifth transistor and a second capacitor. A control electrode of the fifth transistor is coupled to the first node, a first electrode of the fifth transistor is coupled to the second clock signal terminal, and a second electrode of the fifth transistor is coupled to the output signal terminal. The second capacitor is coupled between the first node and the second clock signal terminal.

In some embodiments of the present disclosure, the inverter may include a first circuit and a second circuit. The first circuit may generate the second drive signal according to the first drive signal and the first voltage signal. The second circuit may generate the second drive signal according to the first drive signal and the second voltage signal. The first circuit and the second circuit include respectively different types of transistors.

In some embodiments of the present disclosure, the first circuit may include a sixth transistor. A control electrode of the sixth transistor is coupled to the output signal terminal of the shift register unit, a first electrode of the sixth transistor is coupled to the first voltage signal terminal, and a second electrode of the sixth transistor is coupled to an output terminal of the inverter to provide the second drive signal.

In some embodiments of the present disclosure, the second circuit may include a seventh transistor. A control electrode of the seventh transistor is coupled to the output signal terminal of the shift register unit, a first electrode of the seventh transistor is coupled to the second voltage signal terminal, and a second electrode of the seventh transistor is coupled to the output terminal of the inverter to provide the second drive signal.

In some embodiments of the present disclosure, the first drive signal is a gate drive signal, and the second drive signal is a pixel drive signal.

A second aspect of the present disclosure provides a method for driving the pixel circuitry according to the first aspect of the present disclosure. In this method, an enable signal at a first level, a first clock signal at a first level and a second clock signal at a second level are provided, such that the first drive signal is at a second level, and the second drive signal is at a first level. The enable signal at a second level, the first clock signal at a second level and the second clock signal at a first level are provided, such that the first drive signal is at a first level, and the second drive signal is at a second level. Next, an enable signal at a second level, a first clock signal at a first level and a second clock signal at a second level are provided, such that the first drive signal is at a second level, and the second drive signal is at a first level.

A third aspect of the present disclosure provides an array substrate. The array substrate includes a silicon substrate and a plurality of cascaded pixel circuitries according to the first aspect of the present disclosure formed on the silicon substrate. A first drive signal of a shift register unit of each pixel circuitry is provided to a next pixel circuitry, as an enable signal of a shift register unit of the next pixel circuitry. The first clock signals of adjacent pixel circuitries are opposite in phase, and the second clock signals of the adjacent pixel circuitries are opposite in phase.

A fourth aspect of the present disclosure provides a display panel. The display panel includes the array substrate according to the third aspect of the present disclosure.

A fifth aspect of the present disclosure provides a display device. The display device includes the display panel according to the fourth aspect of the present disclosure.

BRIEF DESCRIPTION OF THE DRAWINGS

To describe the technical solutions of the present disclosure more clearly, the accompanying drawings of the embodiments will be briefly introduced below. It is to be known that the accompanying drawings in the following description merely involve with some embodiments of the present disclosure, but not limit the present disclosure. In the figures.

DETAILED DESCRIPTION

To make technical solutions and advantages of the embodiments of the present disclosure clearer, the technical solutions in the embodiments of the present disclosure will be described clearly and completely below, in conjunction with the accompanying drawings. Apparently, the described embodiments are merely some but not all of the embodiments of the present disclosure. All other embodiments obtained by those of ordinary skill in the art based on the described embodiments without creative efforts shall fall within the protection scope of the present disclosure.

In the description of the present disclosure, unless otherwise stated, term "a plurality of" means two or more, and the orientation or position relations represented by terms of "above", "beneath", "left", "right", "inside", "outside" and the like are orientation or position relations shown based on the accompanying figures, they are merely for the convenience of describing the embodiments of the present disclosure and simplifying the description instead of being intended to indicate or imply the device or element to have a special orientation or to be configured and operated in a special orientation. Thus, they cannot be understood as limiting of the present disclosure.

In the description of the present disclosure, it is to be noted that unless explicitly specified or limited otherwise, terms "installation", "connecting" or "coupling" should be understood in a broad sense, which may be, for example, a fixed connection, a detachable connection or integrated connection, a mechanical connection or an electrical connection, a direct connection or indirect connection by means of an intermediary. For those of ordinary skill in the art, specific meanings of the above terms in the present disclosure may be understood based on specific circumstances.

Generally, the pixel circuitry and the gate driving circuit are arranged apart from one another on the array substrate, such that the circuits occupy larger areas and the power consumption is higher.

Figure 1:
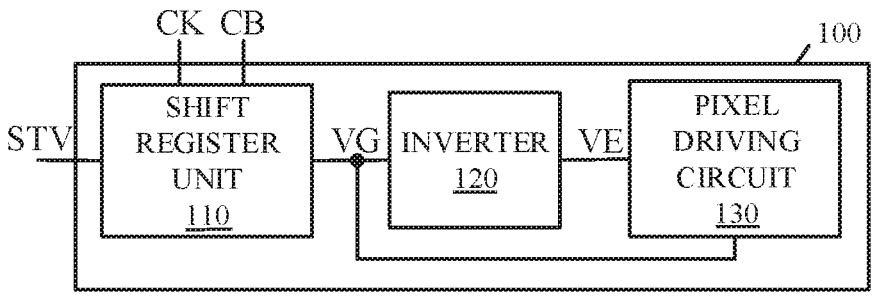
FIG. 1 illustrates a schematic block diagram of a pixel circuitry according to an embodiment of the present disclosure.

FIG. 1 illustrates a schematic block diagram of a pixel circuitry 100 according to an embodiment of the present disclosure. As shown in FIG. 1, the pixel circuitry 100 may include a shift register unit 110, an inverter 120, and a pixel driving circuit 130. The shift register unit 100 may, under the control of an enable signal STV from an enable signal terminal, a first clock signal CK from a first clock signal terminal, and a second clock signal CB from a second clock signal terminal, provide a first drive signal VG via an output signal terminal of the shift register unit, and transmit the first drive signal VG to the inverter 120 and the pixel driving circuit 130. In some embodiments, the first clock signal CK has an opposite phase to the second clock signal CB. The inverter 120 may receive the first drive signal VG and invert the first drive signal VG to generate a second drive signal VE. In addition, the pixel driving circuit 130 may include a light emitting device, and may control the light emitting device according to the first drive signal VG and the second drive signal VE.

In some embodiments of the present disclosure, a gate drive signal and an enable signal are provided through the shift register unit and the inverter, such that the structure of the pixel circuitry may be simplified, and the power consumption may be reduced.

In some embodiments of the present disclosure, the first drive signal VG may be the gate drive signal, which may enable the particular pixel driving circuit 130. The second drive signal VE may be a pixel drive signal and may be transmitted to the enable signal terminal of the pixel driving circuit 130, and may serve as the enable signal of the pixel driving circuit 130.

Hereinafter, a detailed description is made taking an example where the first drive signal VG is the gate drive signal and the second drive signal VE is the pixel drive signal. Those skilled in the art may understand that at least one of the first drive signal VG and the second drive signal VE also may be a signal provided by a signal source.

Figure 2:
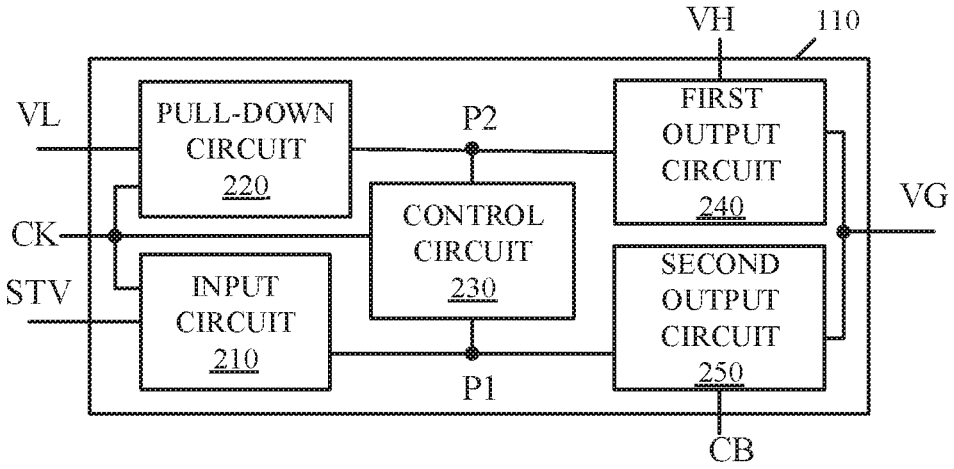
FIG. 2 illustrates a schematic block diagram of a shift register unit according to an embodiment of the present disclosure.

FIG. 2 illustrates a schematic block diagram of a shift register unit 110 according to an embodiment of the present disclosure. As shown in FIG. 2, the shift register unit 110 may include an input circuit 210, a pull-down circuit 220, a control circuit 230, a first output circuit 240, and a second output circuit 250. In some embodiments, the input circuit 210 may control a voltage of a first node P1 according to the first clock signal CK and the enable signal STV. The pull-down circuit 220 may control a voltage of a second node P2 according to the first clock signal CK and a first voltage signal VL from a first voltage signal terminal. The first voltage signal VL may be, for example, a high level signal. The control circuit 230 may control the voltage of the second node P2 according to the voltage of the first node P1 and the first clock signal CK. The first output circuit 240 may provide the gate drive signal VG to the output signal terminal according to the voltage of the second node P2 and a second voltage signal VH from a second voltage signal terminal. The second output circuit 250 may provide the gate drive signal VG to the output signal terminal according to the voltage of the first node P1 and the second clock signal CB.

Figure 3:
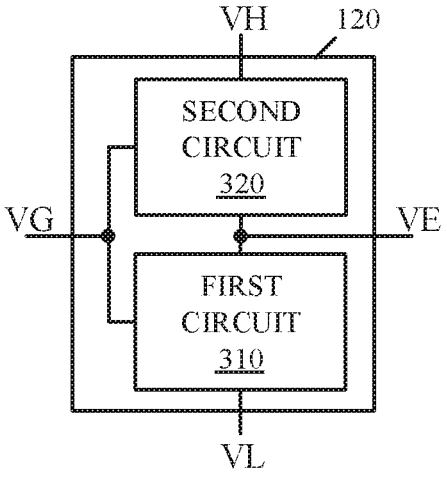
FIG. 3 illustrates a schematic block diagram of an inverter according to an embodiment of the present disclosure.

FIG. 3 illustrates a schematic block diagram of an inverter 120 according to an embodiment of the present disclosure. As shown in FIG. 3, the inverter 120 may include a first circuit 310 and a second circuit 320. The first circuit 310 may provide the pixel drive signal VE under the control of the gate drive signal VG and the first voltage signal VL. The second circuit 320 may provide the pixel drive signal VE under the control of the gate drive signal VG and the second voltage signal VH. The first voltage signal VL may be, for example, a low level signal, and the second voltage signal VH may be, for example, a high level signal.

Figure 4:
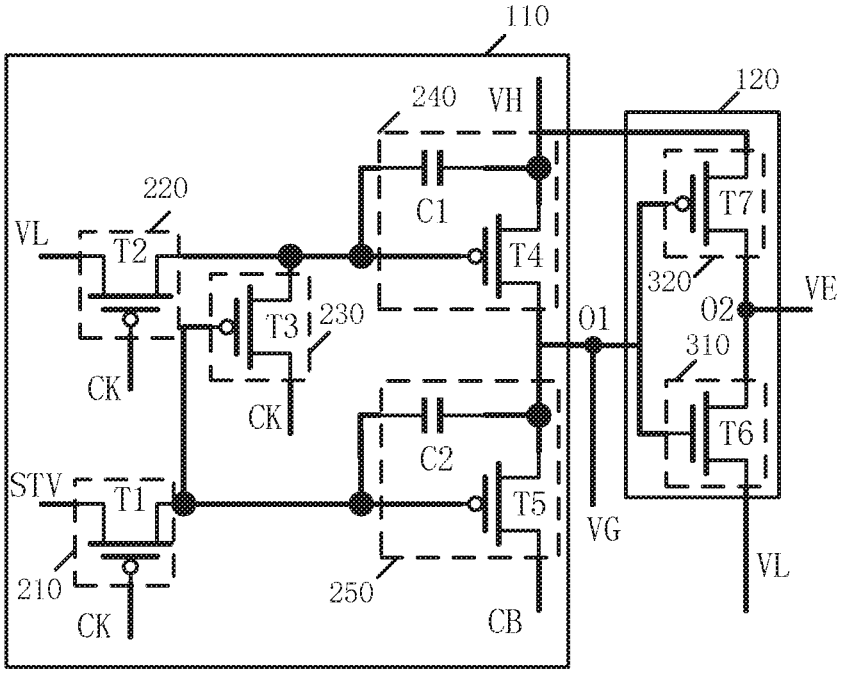
FIG. 4 illustrates an exemplary circuit diagram of a portion of a pixel circuitry according to an embodiment of the present disclosure.

FIG. 4 illustrates an exemplary circuit diagram of a portion of a pixel circuitry according to an embodiment of the present disclosure. In this embodiment, the transistor used may be an N-type transistor or a P-type transistor. Specifically, the transistor may be an N-type or a P-type field-effect transistor (MOSFET) or an N-type or a P-type bipolar transistor (BJT). In some embodiments of the present disclosure, a gate of the transistor is referred to as a control electrode. A source and a drain of the transistor are symmetrical, thus the source and the drain may not be distinguished. That is, the source of the transistor may be referred to as a first electrode (or a second electrode), and the drain of the transistor may be referred to as a second electrode (or a first electrode).

In some embodiments of the present disclosure, the shift register unit 110 may adopt a 5T2C (5 transistors and 2 capacitors) structure. A detailed description is made below by taking a P-type field-effect transistor (PMOS) as an example.

As shown in FIG. 4, in the shift register unit 110, the input circuit 210 may include a first transistor T1. A control electrode of the first transistor T1 is coupled to the first clock signal terminal to receive the first clock signal CK. A first electrode of the first transistor T1 is coupled to the enable signal terminal to receive the enable signal STV. A second electrode of the first transistor T1 is coupled to the first node P1. The first transistor T1 may provide, under the control of the first clock signal CK, the enable signal STV to the first node P1, to control the voltage of the first node P1.

The pull-down circuit 220 may include a second transistor T2. A control electrode of the second transistor T2 is coupled to the first clock signal terminal to receive the first clock signal CK. A first electrode of the second transistor T2 is coupled to the first voltage signal terminal to receive the first voltage signal VL. A second electrode of the second transistor T2 is coupled to the second node P2. The second transistor T2 may provide, under the control of the first clock signal CK, the first voltage signal VL to the second node P2 to control the voltage of the second node P2.

The control circuit 230 may include a third transistor T3. A control electrode of the third transistor T3 is coupled to the first node P1. A first electrode of the third transistor T3 is coupled to the first clock signal terminal to receive the first clock signal CK. A second electrode of the third transistor T3 is coupled to the second node P2. The third transistor T3 may provide, under the control of the voltage of the first node P1, the first clock signal CK to the second node P2 to control the voltage of the second node P2.

The first output circuit 240 may include a fourth transistor T4 and a first capacitor C1. A control electrode of the fourth transistor T4 is coupled to the second node P2. A first electrode of the fourth transistor T4 is coupled to the second voltage signal terminal to receive the second voltage signal VH. A second electrode of the fourth transistor T4 is coupled to the output signal terminal O1 of the shift register unit. The first capacitor C1 is coupled between the second node P2 and the second voltage signal terminal. The fourth transistor T4 may provide, under the control of the voltage of the second node P2, the second voltage signal VH to the output signal terminal O1 to output the gate drive signal VG. The first capacitor C1 may hold the voltage difference between the second node P2 and the second voltage signal VH.

The second output circuit 250 may include a fifth transistor T5 and a second capacitor C2. A control electrode of the fifth transistor T5 is coupled to the first node P1. A first electrode of the fifth transistor T5 is coupled to the second clock signal terminal to receive the second clock signal CB. A second electrode of the fifth transistor T5 is coupled to the output signal terminal O1 of the shift register unit. The second capacitor C2 is coupled between the first node and the second clock signal terminal. The fifth transistor T5 may provide, under the control of the voltage of the first node P1, the second clock signal CB to the output signal terminal O1, to output the gate drive signal VG. The second capacitor C2 may hold the voltage difference between the voltages of the first node and the second clock signal.

In addition, the shift register unit 110 may also adopt other circuit structures, such as 4T1C (4 transistors and 1 capacitor) or the like.

In some embodiments of the present disclosure, the inverter 120 may be implemented using a CMOS process.

As shown in FIG. 4, in the inverter 120, the first circuit 310 may include a sixth transistor T6. A control electrode of the sixth transistor T6 is coupled to the output signal terminal O1 of the shift register unit to receive the gate drive signal VG. A first electrode of the sixth transistor T6 is coupled to the first voltage signal terminal to receive the first voltage signal VG. A second electrode of the sixth transistor T6 is coupled to an output signal terminal O2 of the inverter. The sixth transistor T6 may provide, under the control of the gate drive signal VG, the first voltage signal VG to the output terminal O2 of the inverter, to output the pixel drive signal VE.

The second circuit 320 may include a seventh transistor T7. A control electrode of the seventh transistor T7 is coupled to the output signal terminal O1 of the shift register unit to receive the gate drive signal VG. A first electrode of the seventh transistor T7 is coupled to the second voltage signal terminal to receive the second voltage signal VH. A second electrode of the seventh transistor T7 is coupled to the output signal terminal O2 of the inverter. The seventh transistor T7 may provide, under the control of the gate drive signal VG, the second voltage signal VH to the output terminal O2 of the inverter, to output the pixel drive signal VE.

In some embodiments of the present disclosure, the sixth transistor T6 and the seventh transistor T7 are different types of transistors. For example, the sixth transistor T6 is an NMOS transistor, and the seventh transistor T7 is a PMOS transistor.

In addition, the inverter 120 may also be implemented by using other structures other than the structure of the CMOS inverter.

Figure 5:
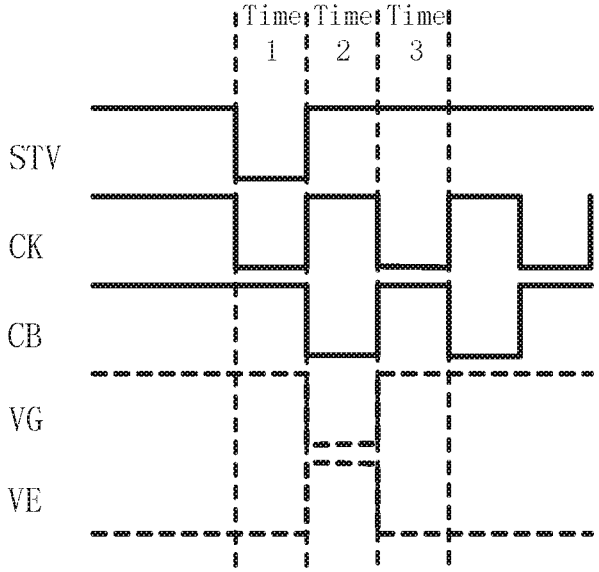
FIG. 5 illustrates a timing chart of signals in a pixel circuitry according to an embodiment of the present disclosure.

FIG. 5 illustrates a timing chart of signals in a pixel circuitry according to an embodiment of the present disclosure. The pixel circuitry may be, for example, the pixel circuitry as shown in FIG. 4. In some embodiments, the first voltage signal VL may be a low level signal, and the second voltage signal VH may be a high level signal.

In the period Time 1, the enable signal STV is at a low level, the first clock signal CK is at a low level, and the second clock signal CB is at a high level. In the circuitry as shown in FIG. 4, the first transistor T1, the second transistor T2, the third transistor T3, the fourth transistor T4, and the fifth transistor T5 are turned on, and both the voltage of the first node P1 and the voltage of the second node are at high levels. Therefore, the output signal terminal O1 of the shift register unit outputs a gate drive signal of a high level, and the output terminal O2 of the inverter outputs a pixel drive signal of a low level. In an embodiment, as the gate drive signal VG is at high level, the sixth transistor T6 is turned on and the seventh transistor T7 is turned off, such that the first voltage signal VL of a low level is provided to the output terminal O2, as the second drive signal VE.

In the period Time 2, the enable signal STV is at a high level, the first clock signal CK is at a high level, and the second clock signal CB is at a low level. In this case, both the first transistor T1 and the second transistor T2 are turned off. The voltage of the first node P1 is held at the low level of the previous period, such that the third transistor T3 and the fifth transistor T5 are held to be turned on. The voltage of the second node P2 becomes a high level, such that the fourth transistor T4 is turned off. Thereby, the output signal terminal O1 of the shift register unit outputs a gate drive signal of a low level, and the output terminal O2 of the inverter outputs a pixel drive signal of a high level. In an embodiment, as the gate drive signal VG is at low level, the sixth transistor T6 is turned off and the seventh transistor T7 is turned on, such that the second voltage signal VL of a high level is provided to the output terminal O2, as the second drive signal VE.

In the period Time 3, the enable signal STV is at a high level, the first clock signal CK is at a low level, and the second clock signal CB is at a high level. Both the first transistor T1 and the second transistor T2 are turned on. The voltage of the first node P1 becomes a high level, such that both the third transistor T3 and the fifth transistor T5 are turned off. The voltage of the second node P2 is at a low level, such that the fourth transistor T4 is turned on. Thereby, the output signal terminal O1 of the shift register unit outputs a gate drive signal of a high level, and the output terminal O2 of the inverter outputs a pixel drive signal of a low level. In an embodiment, as the gate drive signal VG is at high level, the sixth transistor T6 is turned on and the seventh transistor T7 is turned off, such that the first voltage signal VL of a low level is provided to the output terminal O2, as the second drive signal VE.

Alternatively, in other embodiments of the present disclosure, the first drive signal VG can be the pixel drive signal, and the second drive signal can be the gate drive signal. In this situation, the gate drive signal can be generated by inverting the pixel drive signal. Next, the light emitting device can be controlled according to the pixel drive signal and the gate drive signal.

Figure 6:
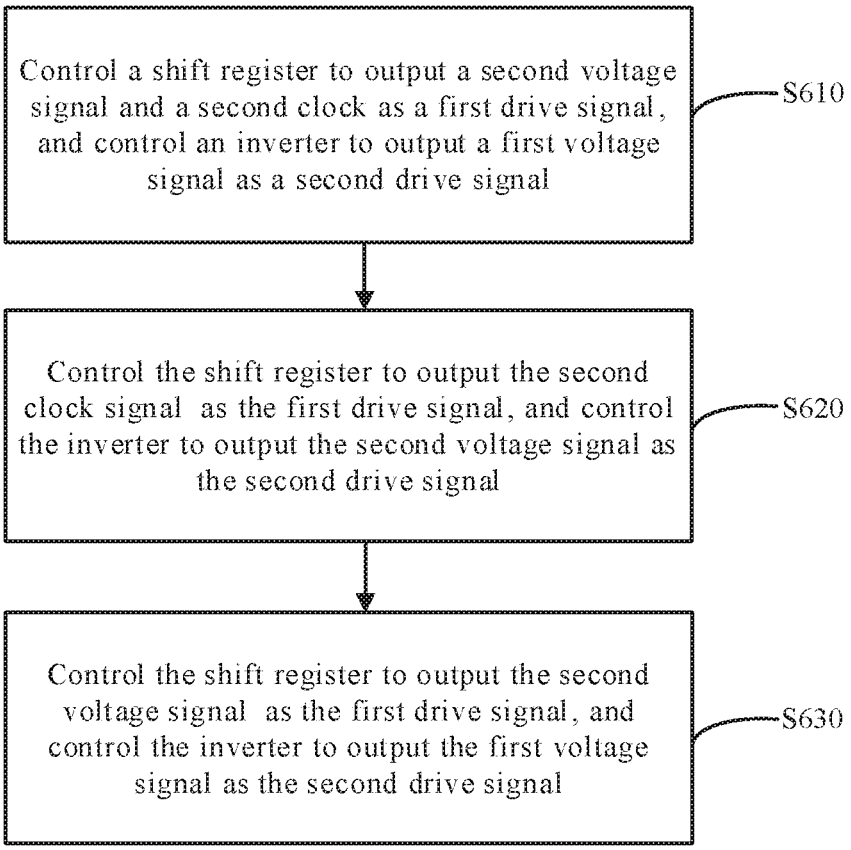
FIG. 6 illustrates a flowchart of a method for driving a pixel circuitry according to an embodiment of the present disclosure.

FIG. 6 illustrates a schematic flowchart of a method for driving a pixel circuitry according to an embodiment of the present disclosure. The pixel circuitry may be, for example, the pixel circuitry according to an embodiment of the present disclosure, which includes a shift register unit, an inverter, and a pixel driving circuit. In an embodiment the pixel circuit may be the pixel circuitry 100 as described above.

In this method, in Step S610, according to an enable signal, a first clock signal, and a second clock signal, a shift register of the pixel circuitry can be controlled to output a second voltage signal and the second clock signal as a first drive signal. According to the first drive signal, an inverter of the pixel circuitry can be controlled to output a first voltage signal as a second drive signal. In an embodiment, an enable signal at a first level, a first clock signal at a first level and a second clock signal at a second level are provided, such that the first drive signal is at a second level, and the second drive signal is at a first level.

In an embodiment, an input circuit 210, a pull-down circuit 220, a control circuit 230, a first output circuit 240, and a second output circuit 250 of a shift register unit 110 in a pixel circuitry 100 can be turned on according to the enable signal STV, the first clock signal CK, and the second clock signal CB. Therefore, the second voltage signal VH and the second clock signal CB can be output via an output signal terminal of the shift register, as the first drive signal VG. A first circuit 310 of an inverter 120 can be turned on according to the first drive signal VG. Therefore, the first voltage signal VL can be output as the second drive signal VE.

In Step S620, according to the enable signal, the first clock signal, and the second clock signal, the shift register can be controlled to output the second clock signal as the first drive signal. According to the first drive signal, the inverter can be controlled to output a second voltage signal as the second drive signal. In an embodiment, the enable signal at a second level, the first clock signal at a second level and the second clock signal at a first level are provided, such that the first drive signal is at a first level, and the second drive signal is at a second level.

In an embodiment, the input circuit 210, the pull-down circuit 220, and the first output circuit 240 can be turned off, and the control circuit 230 and the second output circuit 250 can be turned on, according to the enable signal STV, the first clock signal CK, and the second clock signal CB. Therefore, the second clock signal CB can be output from the output signal terminal of the shift register unit, as the first drive signal VG. A second circuit 320 of an inverter 120 can be turned on according to the first drive signal VG. Therefore, the second voltage signal VH can be provided as the second drive signal VE.

Next, in Step S630, according to the enable signal, the first clock signal, and the second clock signal, the shift register can be controlled to output the second voltage signal as the first drive signal. According to the first drive signal, the inverter can be controlled to output a first voltage signal as the second drive signal. In an embodiment, an enable signal at a second level, a first clock signal at a first level and a second clock signal at a second level are provided, such that the first drive signal is at a second level, and the second drive signal is at a first level.

In an embodiment, the input circuit 210, the pull-down circuit 220, and the first output circuit 240 can be turned on, and the control circuit 230 and the second output circuit 250 can be turned off, according to the enable signal STV, the first clock signal CK, and the second clock signal CB. Therefore, the second voltage signal VH can be output via the output signal terminal of the shift register unit, as the first drive signal VG. The first circuit 310 can be turned on according to the first drive signal VG. Therefore, the first voltage signal VL can be output as the second drive signal VE.

In some embodiments of the present disclosure, the first level is a voltage level allowing the input circuit of the shift register unit to be enabled, such as, a low level (with respect to PMOS transistors in the input circuit). Correspondingly, the second level is a voltage level allowing the input circuit of the shift register unit to be disabled, such as, a high level (with respect to PMOS transistors in the input circuit).

In some embodiments of the present disclosure, the first drive signal may be the gate drive signal, and the second drive signal may be the pixel drive signal.

In some other embodiments of the present disclosure, the first drive signal may be the pixel drive signal, and the second drive signal may be the gate drive signal.

Figure 7:
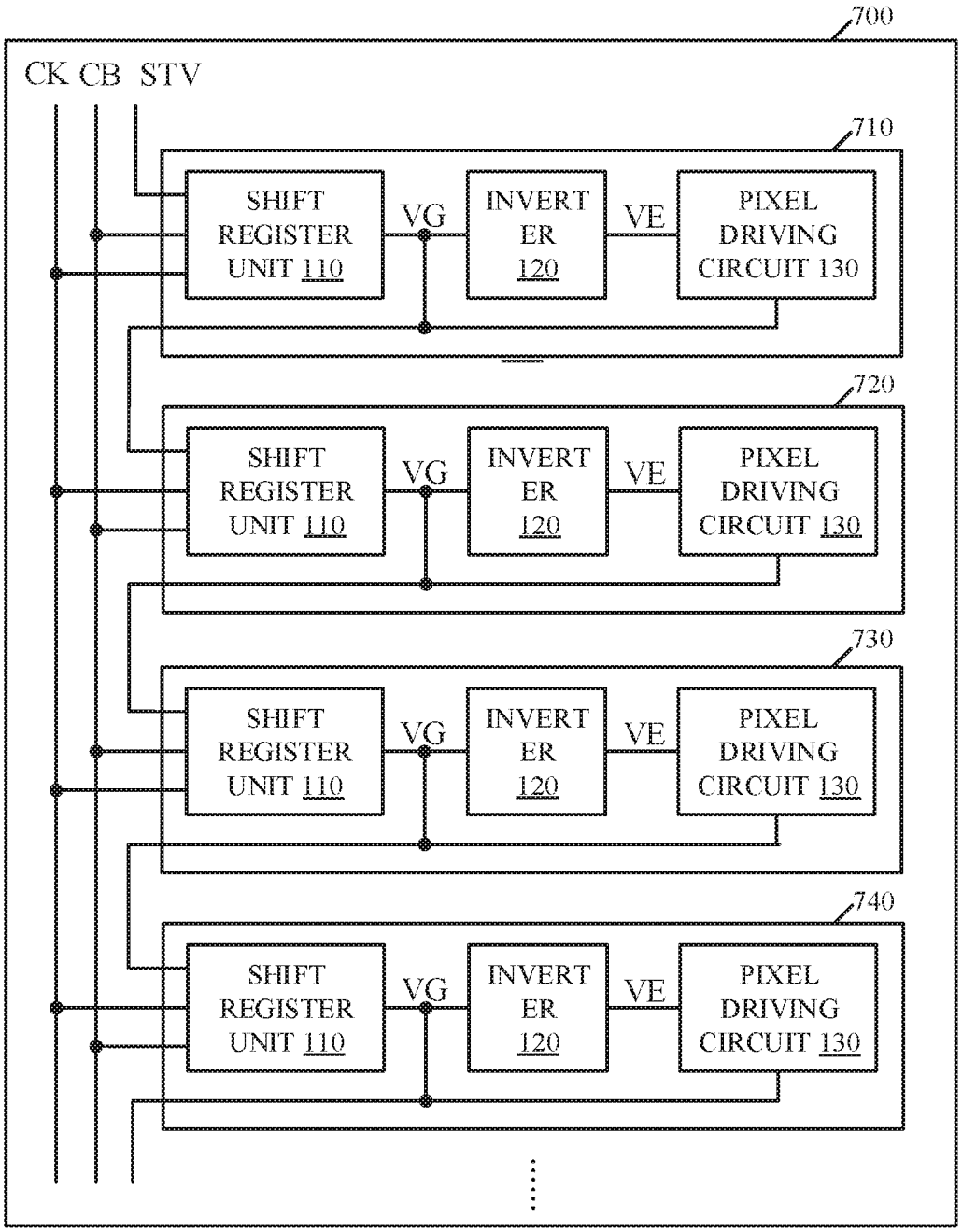
FIG. 7 illustrates a schematic diagram of an array substrate according to an embodiment of the present disclosure.

FIG. 7 illustrates a schematic diagram of an array substrate 700 according to an embodiment of the present disclosure. The array substrate 700 includes a silicon substrate and a plurality of cascaded pixel circuitries formed on the silicon substrate. As shown in FIG. 7, the cascaded pixel circuitries include, for example, a first-stage pixel circuitry 710, a second-stage pixel circuitry 720, a third-stage pixel circuitry 730, and a fourth-stage pixel circuitry 740, and the like. In this embodiment, the pixel circuitry may be, for example, the pixel circuitry as shown in FIG. 1 or FIG. 4.

In this embodiment, the first-stage pixel circuitry receives the enable signal STV. Each pixel circuitry other than the first pixel circuitry is provided with a first drive signal of a shift register unit of a previous pixel circuitry as an enable signal. That is, the first drive signal (such as a gate drive signal VG) of a shift register unit of each pixel circuitry is provided to a next pixel circuitry as an enable signal of a shift register unit of the next pixel circuitry. A first clock signal of the $(2n-1)^{th}$ pixel circuitry is coupled to a second clock signal of the $2n^{th}$ pixel circuitry, and a second clock signal of the $(2n-1)^{th}$ pixel circuitry is coupled to a first clock signal of the $2n^{th}$ pixel circuitry, such that first clock signals of adjacent pixel circuitries have opposite phases and second clock signals of the adjacent pixel circuitries have opposite phases.

Accordingly, output of the first drive signal VG and the second drive signal (for example, the pixel drive signal) VE may be implemented based on one enable signal STV and two clock signals having opposite phase (the first clock signal CK and the second clock signal CB). The first drive signal VG of the $N^{th}$ stage serves as the enable signal STV of the $(N+1)^{th}$ stage, and the second drive signal VE is then generated by the inverter. In this way, the structure of the array substrate is simplified.

In some embodiments of the present disclosure, the silicon substrate used in the array substrate 700 may include monocrystal silicon, and the process uniformity of devices on the monocrystal silicon is better. In the silicon substrate, the pixel circuitry of some embodiments of the present disclosure may be fabricated using a CMOS process.

In another aspect, an embodiment of the present disclosure also provides a display panel including the above array substrate 700. Moreover, an embodiment of the present disclosure also provides a display device including the display panel. The display device may be, for example, a display screen, a mobile phone, a tablet computer, a camera, and a wearable apparatus, etc.

A plurality of embodiments of the present disclosure are described in detail above. However, the scope of protection of the present disclosure is not limited thereto. Apparently, those of ordinary skills in the art may make various modifications, substitutions, and variations on some embodiments of the present disclosure without departing from the spirit and scope of the present disclosure. The scope of protection of the present disclosure is limited by the appended claims.

What is claimed is:

1. A pixel circuitry comprising:

a shift register unit, configured to provide a first drive signal via an output signal terminal of the shift register unit under a control of an enable signal from an enable signal terminal, a first clock signal from a first clock signal terminal, and a second clock signal from a second clock signal terminal;

an inverter, configured to invert the first drive signal to generate a second drive signal; and a pixel driving circuit, configured to control a light emitting device according to the first drive signal and the second drive signal;

wherein the first clock signal has an opposite phase to the second clock signal, wherein the inverter comprises a sixth transistor and a seventh transistor, wherein a control electrode of the sixth transistor is coupled to the output signal terminal of the shift register unit, a first electrode of the sixth transistor is coupled to a first voltage signal terminal, and a second electrode of the sixth transistor is coupled to an output terminal of the inverter to provide the second drive signal, wherein a control electrode of the seventh transistor is coupled to the output signal terminal of the shift register unit, a first electrode of the seventh transistor is coupled to a second voltage signal terminal, and a second electrode of the seventh transistor is coupled to the output terminal of the inverter to provide the second drive signal, and wherein the sixth transistor and the seventh transistor are different types of transistors.

2. The pixel circuitry according to claim 1, wherein the shift register unit comprises:

an input circuit, configured to control a voltage of a first node according to the first clock signal and the enable signal;

a pull-down circuit, configured to control a voltage of a second node according to the first clock signal and a first voltage signal from a first voltage signal terminal;

a control circuit, configured to control the voltage of the second node according to the voltage of the first node and the first clock signal;

a first output circuit, configured to provide the first drive signal to the output signal terminal of the shift register unit according to the voltage of the second node and a second voltage signal from a second voltage signal terminal; and a second output circuit, configured to provide the first drive signal to the output signal terminal according to the voltage of the first node and the second clock signal.

3. The pixel circuitry according to claim 2, wherein the input circuit comprises:

a first transistor, wherein a control electrode of the first transistor is coupled to the first clock signal terminal, wherein a first electrode of the first transistor is coupled to the enable signal terminal, and wherein a second electrode of the first transistor is coupled to the first node.

4. The pixel circuitry according to claim 2, wherein the pull-down circuit comprises:

a second transistor, wherein a control electrode of the second transistor is coupled to the first clock signal terminal, wherein a first electrode of the second transistor is coupled to the first voltage signal terminal, and wherein a second electrode of the second transistor is coupled to the second node.

5. The pixel circuitry according to claim 2, wherein the control circuit comprises:

a third transistor, wherein a control electrode of the third transistor is coupled to the first node, wherein a first electrode of the third transistor is coupled to the first clock signal terminal, and wherein a second electrode of the third transistor is coupled to the second node.

6. The pixel circuitry according to claim 2, wherein the first output circuit comprises:

a fourth transistor, wherein a control electrode of the fourth transistor is coupled to the second node, wherein a first electrode of the fourth transistor is coupled to the second voltage signal terminal, and wherein a second electrode of the fourth transistor is coupled to the output signal terminal; and a first capacitor, coupled between the second node and the second voltage signal terminal.

7. The pixel circuitry according to claim 2, wherein the second output circuit comprises:

a fifth transistor, wherein a control electrode of the fifth transistor is coupled to the first node, wherein a first electrode of the fifth transistor is coupled to the second clock signal terminal, and wherein a second electrode of the fifth transistor is coupled to the output signal terminal; and a second capacitor, coupled between the first node and the second clock signal terminal.

8. The pixel circuitry according to claim 1, wherein the first drive signal is a gate drive signal, and wherein the second drive signal is a pixel drive signal.

9. A method for driving the pixel circuitry according to claim 1, the method comprising:

controlling, according to an enable signal, a first clock signal, and a second clock signal, a shift register unit of the pixel circuitry to output a second voltage signal and the second clock signal as a first drive signal, and controlling, according to the first drive signal, an inverter of the pixel circuitry to output a first voltage signal as a second drive signal;

controlling, according to the enable signal, the first clock signal, and the second clock signal, the shift register unit to output the second clock signal as the first drive signal, and controlling, according to the first drive signal, the inverter to output a second voltage signal as the second drive signal; and controlling, according to the enable signal, the first clock signal, and the second clock signal, the shift register unit to output the second voltage signal as the first drive signal, and controlling, according to the first drive signal, the inverter to output a first voltage signal as the second drive signal.

10. An array substrate comprising:

a silicon substrate; and a plurality of cascaded pixel circuitries according to claim 1 formed on the silicon substrate;

wherein a first pixel circuitry is provided with an enable signal, and each pixel circuitry other than the first pixel circuitry is provided with a first drive signal of a shift register unit of a previous pixel circuitry as an enable signal; and wherein the first clock signals of adjacent pixel circuitries are opposite in phase, and wherein the second clock signals of the adjacent pixel circuitries are opposite in phase.

11. A display panel comprising the array substrate according to claim 10.

12. A display device comprising the display panel according to claim 11.

13. The pixel circuitry according to claim 3, wherein the pull-down circuit comprises:

a second transistor, wherein a control electrode of the second transistor is coupled to the first clock signal terminal, wherein a first electrode of the second transistor is coupled to the first voltage signal terminal, and wherein a second electrode of the second transistor is coupled to the second node.

14. The pixel circuitry according to claim 13, wherein the control circuit comprises:

a third transistor, wherein a control electrode of the third transistor is coupled to the first node, wherein a first electrode of the third transistor is coupled to the first clock signal terminal, and wherein a second electrode of the third transistor is coupled to the second node.

15. The pixel circuitry according to claim 14, wherein the first output circuit comprises:

a fourth transistor, wherein a control electrode of the fourth transistor is coupled to the second node, wherein a first electrode of the fourth transistor is coupled to the second voltage signal terminal, and wherein a second electrode of the fourth transistor is coupled to the output signal terminal; and a first capacitor, coupled between the second node and the second voltage signal terminal.

16. The pixel circuitry according to claim 15, wherein the second output circuit comprises:

a fifth transistor, wherein a control electrode of the fifth transistor is coupled to the first node, wherein a first electrode of the fifth transistor is coupled to the second clock signal terminal, and wherein a second electrode of the fifth transistor is coupled to the output signal terminal; and a second capacitor, coupled between the first node and the second clock signal terminal.

17. The array substrate according to claim 10, wherein the shift register unit in each pixel circuitry comprises:

an input circuit, configured to control a voltage of a first node according to the first clock signal and the enable signal;

a pull-down circuit, configured to control a voltage of a second node according to the first clock signal and a first voltage signal from a first voltage signal terminal;

a control circuit, configured to control the voltage of the second node according to the voltage of the first node and the first clock signal;

a first output circuit, configured to provide the first drive signal to the output signal terminal of the shift register unit according to the voltage of the second node and a second voltage signal from a second voltage signal terminal; and a second output circuit, configured to provide the first drive signal to the output signal terminal according to the voltage of the first node and the second clock signal.

* * * * *